US012268252B1

(12) United States Patent
Norris

(10) Patent No.: US 12,268,252 B1
(45) Date of Patent: Apr. 8, 2025

(54) BRASSIERE WITH SELECTIVE CUP MODIFICATION

(71) Applicant: Merria R. Norris, Weirsdale, FL (US)

(72) Inventor: Merria R. Norris, Weirsdale, FL (US)

( * ) Notice: Subject to any disclaimer, the term of this patent is extended or adjusted under 35 U.S.C. 154(b) by 0 days.

(21) Appl. No.: 18/377,848

(22) Filed: Oct. 9, 2023

(51) Int. Cl.
*A41C 3/00* (2006.01)

(52) U.S. Cl.
CPC ..... *A41C 3/0028* (2013.01); *A41C 3/0092* (2013.01)

(58) Field of Classification Search
CPC .... A41C 3/0028; A41C 3/0092; A41C 3/0071
USPC ..... 450/68
See application file for complete search history.

(56) References Cited

U.S. PATENT DOCUMENTS

| | | | | |
|---|---|---|---|---|
| 7,001,240 | B1 | 2/2006 | Huffman-Jimenez | |
| 7,118,444 | B2 | 10/2006 | Newman | |
| 7,407,430 | B1 * | 8/2008 | Wanzenbock | A41C 3/02 450/82 |
| 7,695,343 | B2 | 4/2010 | Nobbs | |
| 8,708,773 | B2 | 4/2014 | Afxentiou | |
| 9,408,420 | B2 | 8/2016 | Betts | |
| 9,788,578 | B2 | 10/2017 | Betts | |
| 9,943,119 | B2 | 4/2018 | Solotoff | |
| 9,961,946 | B2 | 5/2018 | Calhoun | |
| 10,334,890 | B2 | 7/2019 | Sobah | |
| 2006/0003669 | A1 * | 1/2006 | Li | A41F 1/006 450/58 |
| 2012/0084995 | A1 * | 4/2012 | Vogel | D06F 58/48 34/492 |
| 2018/0014579 | A1 * | 1/2018 | Gumlaw | A41C 3/02 |
| 2018/0325185 | A1 * | 11/2018 | Sakai | A41C 3/0028 |
| 2019/0313706 | A1 * | 10/2019 | Simms | A41C 3/0028 |

* cited by examiner

*Primary Examiner* — Timothy K Trieu
(74) *Attorney, Agent, or Firm* — Cramer Patent & Design, PLLC.; Aaron R. Cramer

(57) ABSTRACT

A brassiere with selective cup modification has adjustable straps with clips, hooks for securing it around the waist of a user, cups to support the breasts, and a bone structure in both the cups and the wings to give the garment a semi-rigid structure. Between the cups, there is a center gore with hole sliders and keyholes. The brassiere has a gel reservoir bag in each wing that can send gel to an expandable bag in the cup through a tube. This adds balance to the bra and adjustability. This gel movement and other structural parts can be changed using a set of mechanical wheels, sliders, and a pair of keys. These keys fit into the keyholes, giving control over the features of the bra, similar to the mechanism that pulls the straps back. The brassiere also has different tracks, wheels, valves, and layers of fabric to ensure the gel moves and spreads evenly and that the breasts appear symmetrical.

20 Claims, 12 Drawing Sheets

BRASSIERE WITH SELECTIVE CUP MODIFICATION

RELATED APPLICATIONS

None.

FIELD OF THE DEVICE

The present device relates to a brassiere wherein each cup is capable of being selectively modified, such as an enlargement or a reduction in size.

BACKGROUND OF THE DEVICE

The brassiere is a common piece of underwear for women that not only enhances their appearance but also offers support for the breasts. Although the brassiere has fulfilled these functions throughout the years in a design that has, for the most part, remained constant, it is not without its flaws. In most cases, it does not have a mechanism for adjusting the size of the breasts, despite the fact that it is relatively adjustable in terms of strap length and chest measurement. This is somewhat odd given that it is a well-established fact that a typical woman would typically have one (1) breast that is at least somewhat larger than the other breast.

Because of this, a woman will need to try on numerous bras of varied sizes and brands before finding the one that offers the optimal level of support. Then, as a result of changes in body size brought on by aging or body growth, the brassiere that formerly fit properly no longer does. Even with a prosthesis, women who have had a single mastectomy still have to cope with the look of unequal breasts when they wear a brassiere. This is the case even when the breasts are replaced. Therefore, there is a need for a method through which a brassiere can accept different breast sizes in order to present a consistent and equal look to the outside world. This requirement was satisfied with the invention of the brassiere, which features interchangeable cup configurations.

SUMMARY OF THE DEVICE

Embodiments of the present disclosure may include a brassiere with selective cup modification including a pair of straps including a first strap and a second strap each having a respective first adjustable clip and second adjustable clip. Embodiments may also include a pair of hooks including a first plurality of hooks and a second plurality of hooks each secured to a respective distal end of a pair of wings including a first wing and a second wing.

Embodiments may also include a pair of cups including a first cup secured to a proximal end of the first wing and a second cup secured to a proximal end of a second wing. Embodiments may also include a bone structure including a plurality of bones disposed within a periphery of the pair of. Embodiments may also include cups and disposed within the pair of wings thereby providing the brassiere with a semi-rigid framework.

Embodiments may also include a center gore disposed between the pair of cups configured to hold each cup at a set distance from each other. Embodiments may also include a first hole slider disposed within the gore and adjacent a proximal edge of the first cup. Embodiments may also include a second hole slider disposed within the gore and adjacent a proximal edge of the second cup, the second hole slider being positioned in mirror opposite to the first hole slider.

Embodiments may also include a first keyhole disposed within the gore and centrally subjacent the first hole slider and the second hole slider. Embodiments may also include a second keyhole disposed within the gore and centrally superjacent the first hole slider and the second hole slider. In some embodiments, each of the first adjustable clip and the second adjustable clip permits a user to adjust a length of the first strap and the second strap.

In some embodiments, the plurality of hooks permit the user to secure the brassiere about a torso of the user when the first plurality of hooks and the second plurality of hooks may be removably engaged. In some embodiments, the first cup and the second cup may be each configured to support and retain a respective breast of the user. In some embodiments, a distal end of the first strap and the second strap may be secured to a respective upper side of the first wing and the second wing and adjacent the respective first plurality of hooks and the second plurality of hooks. In some embodiments, a proximal end of each respective strap may be secured to an upper side of each respective cup. In some embodiments, the brassiere may be adapted to provide an outward appearance of symmetrical breasts for a user with a pair of different-sized breasts.

In some embodiments, the brassiere may include a gel reservoir bag located within each first wing and second wing, the gel reservoir bag being filled with a gel that retains its structural form during movement. In some embodiments, the gel from the gel reservoir bag may be capable of being transported via a tube to a breast cup expandable bag through a tube insert. In some embodiments, the breast cup expandable bag may be constricted by an expandable round elastic featuring a roller wheel on each end that traverse a movable structure.

In some embodiments, the movement of the breast cup expandable bag may be regulated by a motion of a seam layer into and out of a base component, which interfaces with the first hole slider, the second hole slider, and the first keyhole. In some embodiments, the base component may include a set of four axle pins attached to a base plate. Embodiments may also include a pair of two upper mechanical wheels corresponding to the first hole slider and the second hole slider. Embodiments may also include a first key wheel in mechanical communication with the pair of two upper mechanical wheels. Embodiments may also include a spinner wheels mounted atop each one mechanical wheel adapted to coil and store the seam layer.

In some embodiments, the base component may include a cloth layer interfacing with the spinner wheel, and arms inked to a second key wheel which engage a track guard in each cup. In some embodiments, the gel reservoir bag includes a cloth layer positioned on its top and bottom, with rollable wheels sewn inside. In some embodiments, the rollable wheels propel the gel reservoir bag along a one-way track guard situated above a movable track.

Embodiments may also include rollable balls may be situated on a respective distal side of the plurality of bone allowing for the movement of the cloth layer along the side of the plurality of bone, and a tube directs the gel below the plurality of bone with the plurality of bone functioning as a scraper, facilitating the movement of the gel to the location of the tube. In some embodiments, the brassiere may include an adjustment key configured for insertion into the first keyhole to engage with mechanical wheels or each respective key wheel. In some embodiments, the adjustment key includes a key shaft and a key head which can be ornately decorated.

In some embodiments, the arms act as a retractable component of the second keyhole wheel and may be connected to the track guards inside each cup, enabling a repositioning of the track guards upon rotation of the second keyhole. In some embodiments, the brassiere may include a valve slide associated with the tube for controlling a flow of gel between the gel reservoir bag and the expandable bag. Embodiments may also include a movable track incorporated in the wing and cup for aiding in a movement of the gel and associated components. Embodiments may also include roller wheels positioned along the movable track for facilitating the movement of associated components. Embodiments may also include a pulley locking wheel track routed around roller wheels and controlled by an extra cloth layer.

In some embodiments, the tube may be positioned at a bottom of the bone structure associated with the wing, facilitating a scraping or pushing of gel into the tube. In some embodiments, the valve slide may be controlled by a wire positioned within the movable track, and the wire's position may be determined by at least one of a first hole slider and a second hole slider.

In some embodiments, the extra cloth layer may be further routed on a distal side of a bone structure as compared to an associated cup. In some embodiments, the movable track may include a track guard positioned over a top and bottom of the wing, providing protection and aiding in an operation of associated components. In some embodiments, the brassiere may include a retractable feature within the cup, the retractable feature operating in conjunction with a series of slider holes and the movable track.

In some embodiments, the retractable feature may be controlled by turning a second keyhole, which in turn may be connected to an arm that modulates the position of the track guard. In some embodiments, the gel reservoir bag may be bordered by the extra cloth layer and may be positioned within a fabric of the brassiere, further including a pulley track external to the fabric, the pulley track being controlled by the extra cloth layer. In some embodiments, the adjustment key with a key head in a form of a Viking warrior sword interfaces specifically with the first keyhole. In some embodiments, the adjustment key with a key head in a form of an angel wing interfaces specifically with the second keyhole and may be used for retracting the brassiere.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

DESCRIPTIVE KEY

Figure 1:
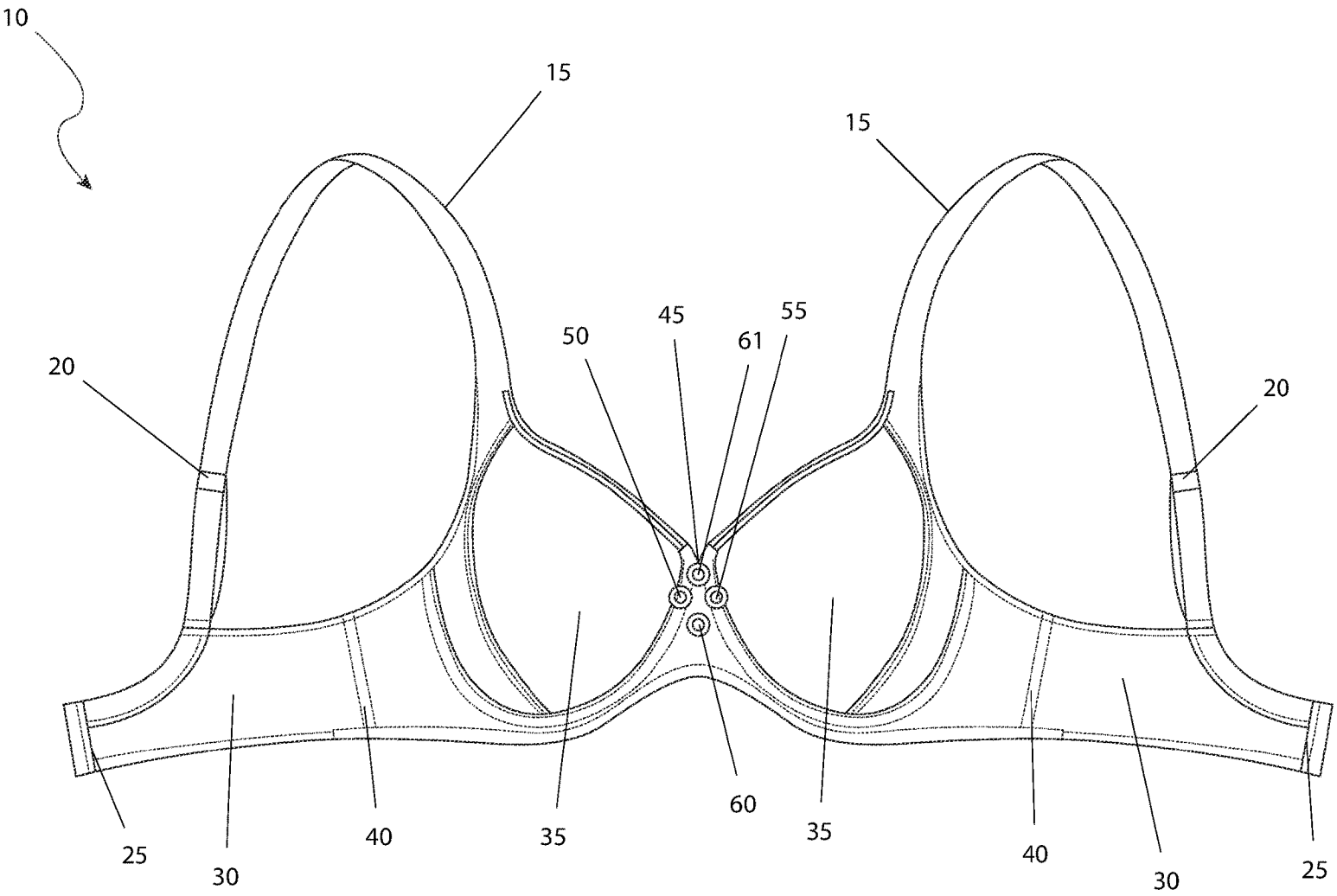
FIG. 1 is a front view of the brassiere with modifiable cup configurations 10, according to the preferred embodiment of the present device.

10 brassiere
15 strap
20 adjustable clip
25 hook
30 wing
32 secondary wing layer
35 cup
40 bone
45 center gore
50 first hole slider
55 second hole slider
60 first keyhole
61 second keyhole-retractable
65 gel reservoir bag
66 cloth layer
67 track guard
68 movable track
69 padding
70 gel
71 arm
72 second keyhole wheel
75 tube
80 breast cup expandable bag
85 tube insert
90 expandable round elastic
95 roller wheel
96 balls
100 movable structure
105 retractable travel path "a"
110 seam layer
115 base component
120 wing inner fabric layer
125 wing outer fabric layer
130 seamed area
135 cup inner fabric layer
140 cup outer fabric layer

145 interstitial space
150 axle pin
155 base plate
160 mechanical wheel
165 key wheel
170 spinner wheel
175 bobbin core
180 bobbin outer plate
185 retaining space
186 locking component
190 adjustment key
195 key shaft
200 key head
205 valve slide
210 valve wire
215 pulley track
220 fabric
225 pulley locking wheel track
230 pulley
235 extra cloth layer
240 slider hole
245 movable track
250 cloth under pulling tension
255 first decorative embodiment of a key head
260 second decorative embodiment of a key head

1. Description of the Device

The best mode for carrying out the device is presented in terms of its preferred embodiment, herein depicted within FIGS. 1 through 12. However, the device is not limited to the described embodiment, and a person skilled in the art will appreciate that many other embodiments of the device are possible without deviating from the basic concept of the device and that any such work around will also fall under scope of this device. It is envisioned that other styles and configurations of the present device can be easily incorporated into the teachings of the present device, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

2. Detailed Description of the Figures

Referring now to FIG. 1, a front view of a brassiere with modifiable cup configurations 10, according to the preferred embodiment of the present device is disclosed. The brassiere with modifiable cup configurations 10 provides users, who have different-sized breasts, the ability to provide an outward appearance of symmetrical breasts. The brassiere with modifiable cup configurations 10 provides the overall appearance of a conventional brassiere and includes various components including but not limited to: straps 15, adjustable clips 20, hooks 25, wings 30, cups 35, bones 40, and a center gore 45. In addition, the brassiere with modifiable cup configurations 10 is provided with a first hole slider 50, a second hole slider 55, and a first keyhole 60, which are used to adjust the fill, including height and thickness of the cups 35. Further detail on the configuration and operation of the first hole slider 50, the second hole slider 55 and the first keyhole 60 will be provided herein below. As is the case with conventional brassieres, the brassiere with modifiable cup configurations 10 would be made available in multiple sizes, colors, and styles to suit the tastes of all users. The outer and inner surfaces of the brassiere with modifiable cup configurations 10 would be manufactured from conventional textiles including but not limited to: cotton, rayon, silk, spandex, polyester, and lace.

Figure 2:
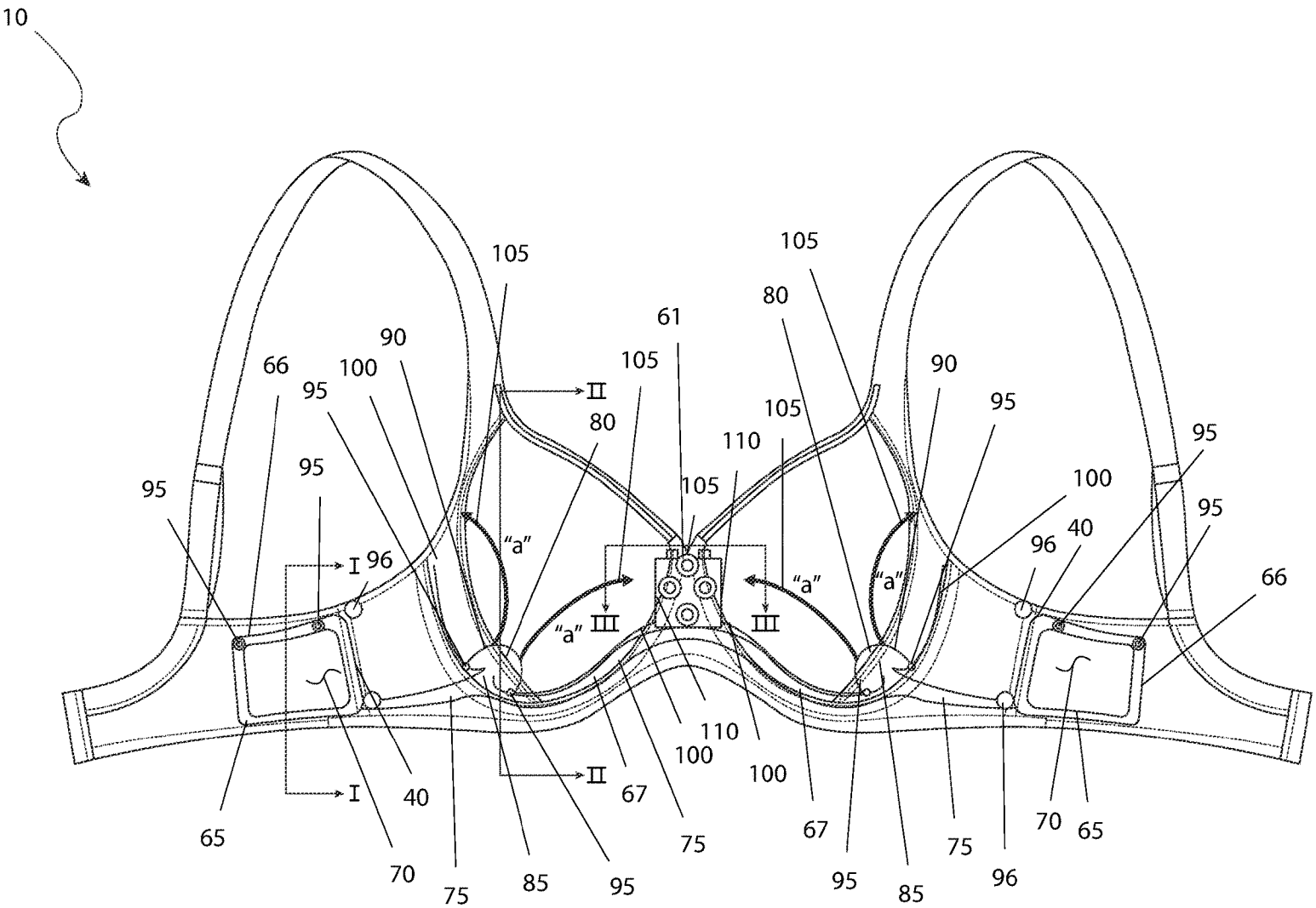
FIG. 2 is an interior view of the brassiere with modifiable cup configurations 10; depicting internal components, according to the preferred embodiment of the present device.

Referring next to FIG. 2, an interior view of the brassiere with modifiable cup configurations 10 depicting internal components, according to the preferred embodiment of the present device is depicted. A gel reservoir bag 65 is provided in each wing 30 of the brassiere with modifiable cup configurations 10. The gel reservoir bag 65 is filled with a gel 70 that will not break down with time or use but maintains its structure form/bond during movement. The gel 70 travels from the gel reservoir bag 65 through a tube 75 into a breast cup expandable bag 80 via a tube insert 85. The breast cup expandable bag 80 is restrained by an expandable round elastic 90. The expandable round elastic 90 is provided with a roller wheel 95 on each end that rides along a movable structure 100, such as a wire or plastic form. This allows conforming of the breast cup expandable bag 80 along a retractable travel path "a" 105.

Movement of the breast cup expandable bag 80 is controlled by movement of a seam layer 110 in and out of a base component 115. The base component 115 works with the first hole slider 50, the second hole slider 55, and the first keyhole 60, (all shown in FIG. 1). It is noted that all of previously described components of FIG. 2 and duplicated on each side of the brassiere with modifiable cup configurations 10. The gel reservoir bag 65 is provided with a cloth layer 66 on both the top and bottom in which the roller wheels 95 sewn inside. The roller wheels 95 pull the gel reservoir bag 65 along a one-way track guard 67. Underneath the one-way track guard 67 is a movable track 68 which pull the roller wheel 95 over the one-way track guards 67. The extra cloth layer will pull over and under the bone and round the rollable balls 96. The rollable balls 96 keep the cloth layer 66 from getting stuck and pulling within the wing 30. Padding 69 is provided to cover both the one-way track guards 67 and the movable track 68 such that they are not readily felt by the wearer of the brassiere with modifiable cup configurations 10 along with other internal components.

The rollable balls 96 are located on the distal side of the bone 40, which allows the flow of the cloth layer 66 to be pulled along the side of the bone 40. Top rollable balls 96 is located on the opposite side of the bone 40, while the cloth layer 66, located at the bottom, is pulled underneath the bottom rollable ball 96 by the tube 75. The tube 75 is routed under the bottom of the bone 40, whereas the bone 40 functions as a scraper which pushes the gel 70 to the bottom of the bone 40 to the location of the tube 75, as no other exit ports for the gel 70 are available. The tube 75 is also routed to the middle of the brassiere with modifiable cup configurations 10 thus allowing the gel 70 to be pulled by the roller wheel 95 and pushed into the tube 75 at the same time from each wing 30.

Figure 3:
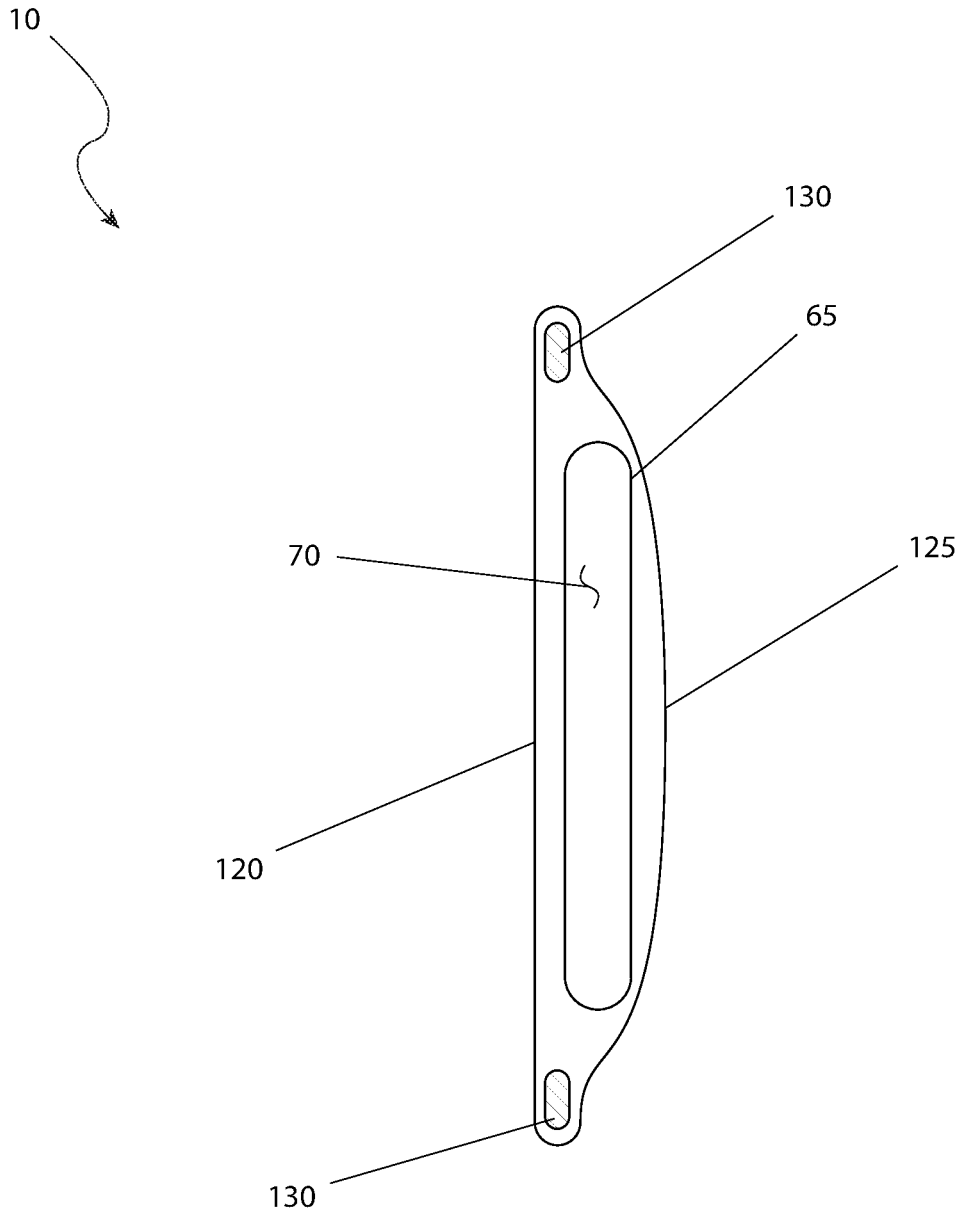
FIG. 3 is a sectional view of the brassiere with modifiable cup configurations 10, as seen along a line I-I, as shown in FIG. 2, according to the preferred embodiment of the present device.

Referring now to FIG. 3, a sectional view of the brassiere with modifiable cup configurations 10, as seen along a line I-I, as shown in FIG. 2, according to the preferred embodiment of the present device is shown. The gel reservoir bag 65, as contained within the two (2) wings 30 (as shown in FIG. 1) is held between a wing inner fabric layer 120 and a wing outer fabric layer 125. The wing inner fabric layer 120 and the wing outer fabric layer 125 are affixed to each other via a seamed area 130, envisioned to be formed via stitching or other attachment area. The seamed area 130 contains the roller wheel 95, which are sewed inside. The roller wheels 95 are sewed on each end, the top, and bottom of the cloth layer 66 to pull the wheels 95 along the moveable track 68. The area as depicted in FIG. 3, is envisioned to be of a low-profile design that will not restrict the movement of the wearer, whether or not the gel reservoir bag 65 is fully filled or fully empty of gel 70.

Figure 4:
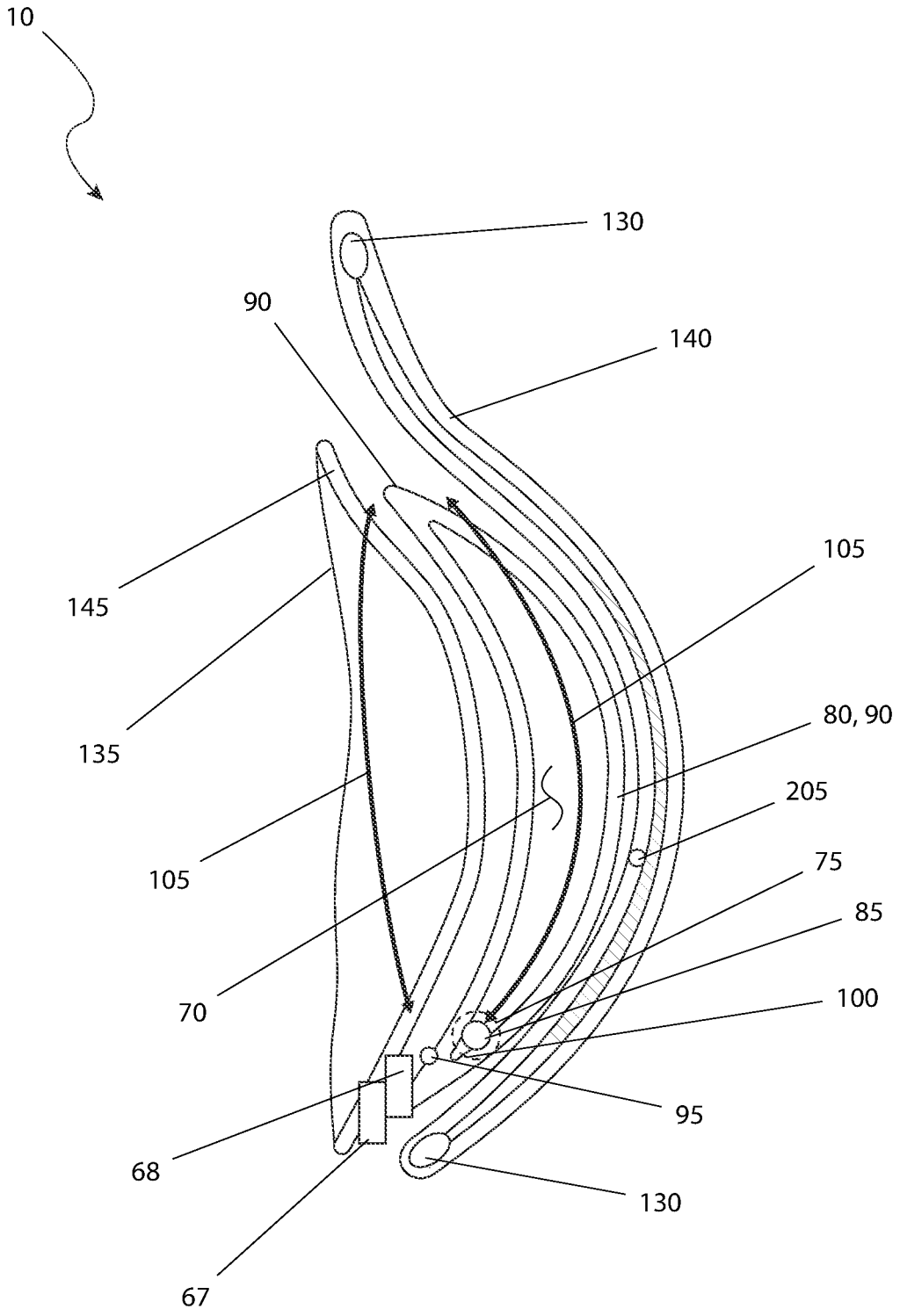
FIG. 4 is a sectional view of the brassiere with modifiable cup configurations 10, as seen along a line II-II, as shown in FIG. 2, according to the preferred embodiment of the present device.

Referring next to FIG. 4, a sectional view of the brassiere with modifiable cup configurations 10, as seen along a line II-II, as shown in FIG. 2, according to the preferred embodiment of the present device is disclosed. In a manner similar to FIG. 3, a cup inner fabric layer 135 and a cup outer fabric layer 140 are joined by a seamed area 130. The interstitial space 145 may be filled by the breast cup expandable bag 80, as it moves along the retractable travel path "a" 105, in a three-dimensional (3D) manner in reference to FIG. 2. The gel 70 inside forms the shape of the wearer's body along the cup inner fabric layer 135 while produces an aesthetically pleasing breast appearance on the cup outer fabric layer 140. The expandable round elastic 90 is visible in this view, as well as the movable structure 100 as it forms a stable perimeter for the filled breast cup expandable bag 80, whether not filled, minimally filled, partially filled, or maximum filled. The expandable round elastic 90 is provided with a roller wheel 95 on either side, so as to allow the expandable round elastic 90 to push up against the track guards 67 as the gel 70 flows into the expandable round elastic 90. Located on the expandable round elastic 90 is the breast cup expandable bag 80 into which the gel 70 will flow into. The breast cup expandable bag 80 is provided with an expandable round elastic 90 at the same location and is attached to the back side thereof. The rear surface of the breast cup expandable bag 80 is of a structured material such that the gel 70 will flow upwards and outwards. The track guard 67 and the movable track 68 are the left and right side of the roller wheel 95 respectively. The movable structure 100 comprises roller wheels 95 and is sewn into the left and right side of the expandable round elastic 90. Each of the roller wheels 95 moves up the track guard 67 and is located atop the movable track 68.

The movable structure 100 includes the roller wheel 95 which roll over the track guards 67. The track guards 67 lie on the movable track 68. The movable track 68 in turn pulls and/or pushes the roller wheel 95. The expandable round elastic 90 is physically attached to the roller wheel 95. The tube 75 and the tube insert 85 are also visible in this figure. It is noted that there is no gel 70 in the breast cup expandable bag 80 until said gel 70 is pushed into the breast cup expandable bag 80 from the wing 30 when the first keyhole 60 (as shown in FIG. 2 is rotated). A valve slide 205 is provided to control the gel 70 as provided via the tube insert 85.

Figure 5:
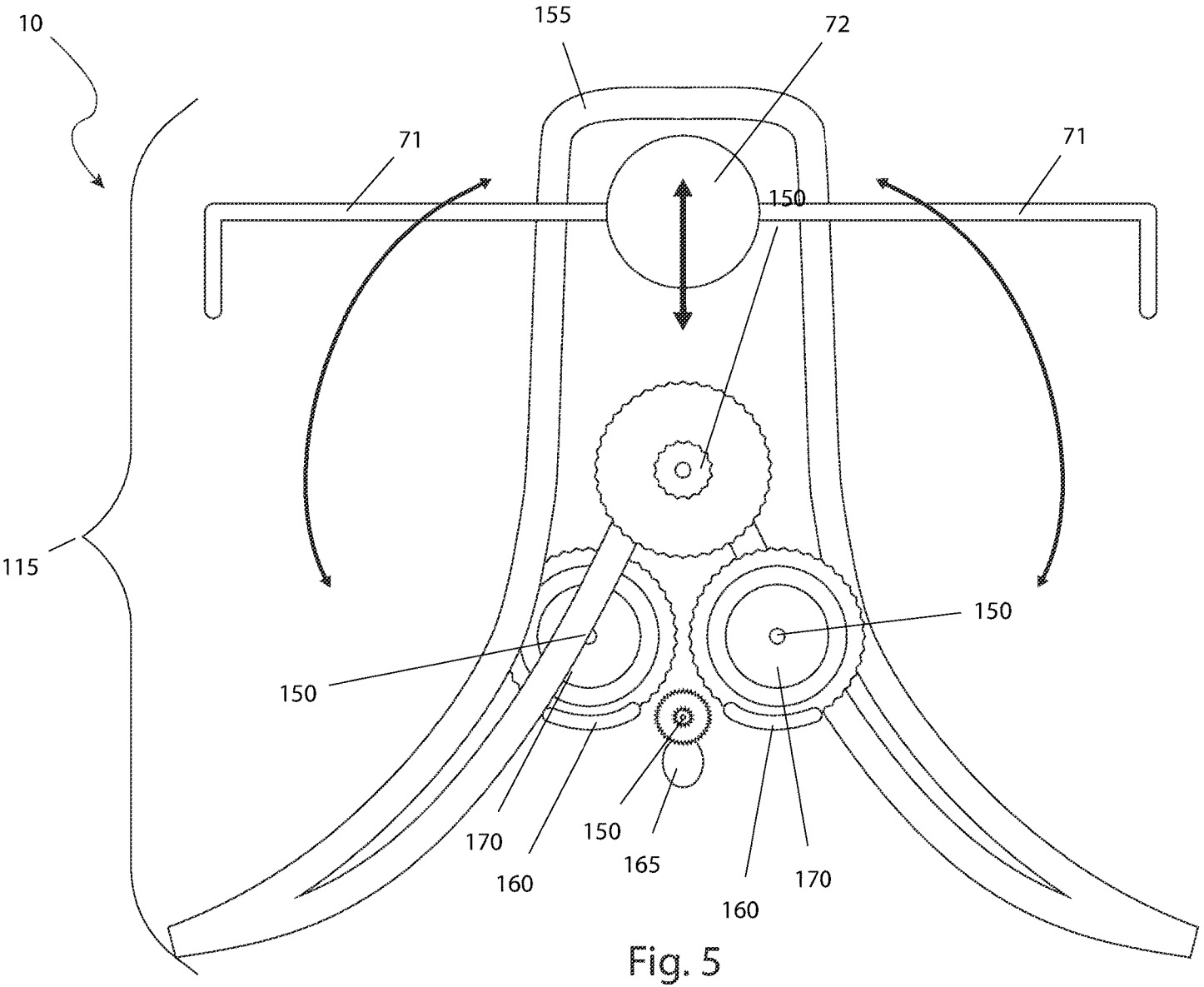
FIG. 5 is a detailed view of the base component 115, as used with the brassiere with modifiable cup configurations 10, according to the preferred embodiment of the present device.

Referring now to FIG. 5, a detailed view of the base component 115, as used with the brassiere with modifiable cup configurations 10, according to the preferred embodiment of the present device is depicted. The base component 115 is generally rectangular in nature and includes four (4) axle pins 150 firmly affixed to a base plate 155. The base plate 155, functioning similar in manner to a watch case that holds internal rotating wheels, then provides mounting for two (2) upper mechanical wheels 160 which correspond to the first hole slider 50 and the second hole slider 55 (as shown in FIG. 1). A key wheel 165 is then in geared mechanical communication with both mechanical wheels 160 and corresponds to the first keyhole (key insert) 60 (as shown in FIG. 1). A spinner wheel 170 (total of two (2)) is then affixed atop each mechanical wheel 160. The spinner wheels 170 each accept, coil, and store, the seam layer 110. As such, the spinner wheels 170 simultaneously pull the seam layer 110 around the cups 35 (as shown in FIG. 1), from both wings 30 (as shown in FIG. 1) and as such, pulls the gel reservoir bags 65, which hold the gel 70, (as shown in FIG. 2) into the tube 75. The key wheel 165 drives both mechanical wheels 160. Further usage on the initial setup and use of the base component 115 will be provided herein below.

The cloth layer 66 is routed into the spinner wheel 170. Arms 71 are attached to the second keyhole wheel 72, which is stand alone, and is attached directly to the track guard 67 in each cup 35. When activated by the second keyhole-retractable 61 (not shown in this FIG.), it positions the track guard 67 in each cup 35. When turned back to its original position, it places the track guards back up. The second keyhole-retractable 61 can only be manipulated by the second decorative embodiment of a key head 260 (not shown in this figure).

Figure 6:
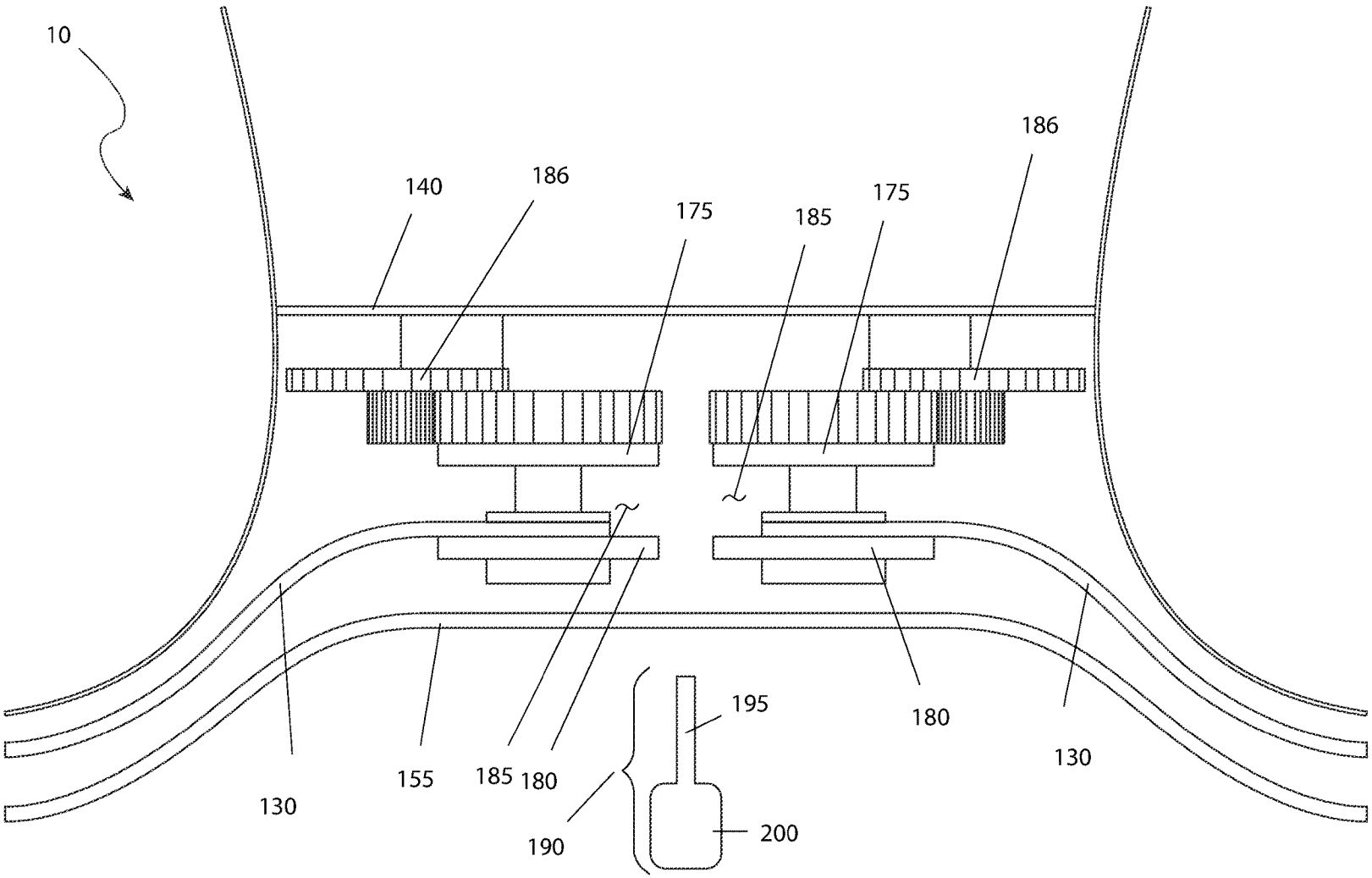
FIG. 6 is a sectional view of the base component 115 as seen along a line III-III, as shown in FIG. 2, and as used with the brassiere with modifiable cup configurations 10, according to the preferred embodiment of the present device; and, FIG. 7 is a view of the gel reservoir bag 65, as used with the brassiere with modifiable cup configurations 10, according to the preferred embodiment of the present device.

Referring to FIG. 6, a sectional view of the base component 115 as seen along a line III-III, as shown in FIG. 2, and as used with the brassiere with modifiable cup configurations 10, according to the preferred embodiment of the present device is shown. The base plate 155 provides a structural foundation for the mechanical wheels 160 and the key wheel 165 as aforementioned described. The spinner wheels 170 provide a bobbin core 175 surrounded by two (2) bobbin outer plates 180 which provides a retaining space 185 for holding of the seam layer 110 (as shown in FIG. 5). An adjustment key 190 is then inserted through the first keyhole 60 (which are as shown in FIG. 1) to engage the respective mechanical wheels 160 or the key wheel 165 (in case of the first keyhole 60). The adjustment key 190 includes a key shaft 195 and a key head 200 which may be provided with decorative indicia included, but not limited to: letters, words, or images such as angels, wings, swords, or the like. Further description on the operation of the various adjustment key 190 in each of the two (2) keyholes (the first keyhole 60 and the second keyhole-retractable 61) will be provided herein below.

The arms 71 are provided as a retractable component of the second keyhole wheel 72 (as shown in FIG. 5) and are attached to the track guards 67 (not shown in this FIGURE, due to illustrative limitations) within each cup 35. When the second keyhole-retractable 61 (as shown in FIGURE second keyhole-retractable 61) is turned it lays the track guard 67 down. When turned in an opposite direction, this action places the track guards 67 into their original position. The spinner wheels 170 are independently locked into position by a locking component 186.

Figure 7:
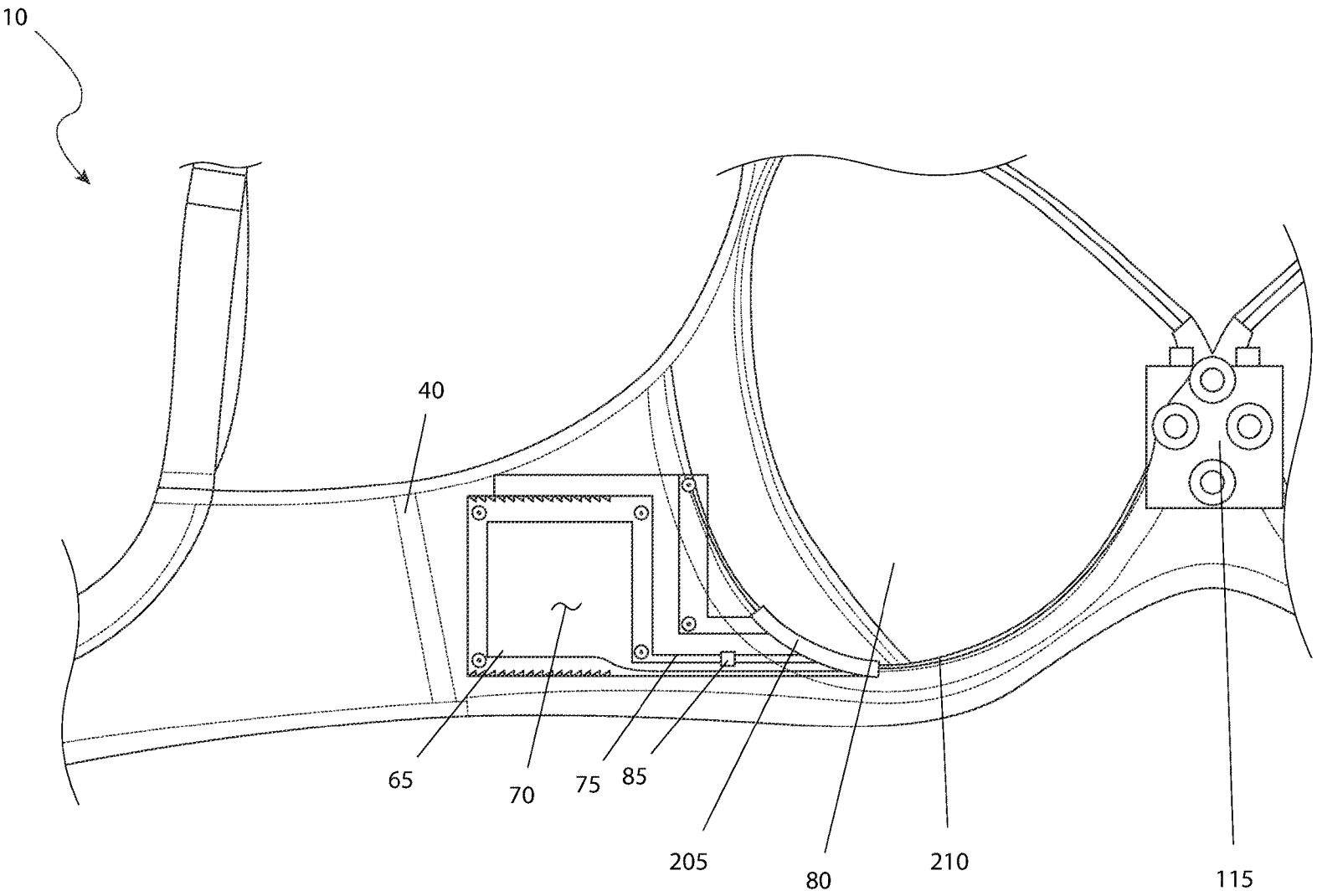

Referring next to FIG. 7, a view of the gel reservoir bag 65, as used with the brassiere with modifiable cup configurations 10, according to the preferred embodiment of the present device is disclosed. This view discloses only one (1) wing 30 and one (1) cup 35 for purposes of clarity. It is noted that the opposite wing 30 and the cup 35 are symmetrical in nature. The gel reservoir bag 65 contains gel 70 as aforementioned described. The wing 30 is routed to the bone 40, in which the tube 75 is at the bottom of the bone 40, allowing gel 70, through the tube 75 and up in into the tube insert 85, thus pushing the gel 70 into the breast cup expandable bag 80 The valve slide 205 is provided to control the gel 70 as provided via the tube insert 85. The valve slide 205 is controlled via a valve wire 210, laying within the movable track 68. The valve wire 210 is controlled by the first hole slider 50 or the second slider hole 55. The tube 75 lays on the bottom of the bone 40 allowing the gel 70 to be pushed (or scraped) down into the tube 75.

Figure 8:
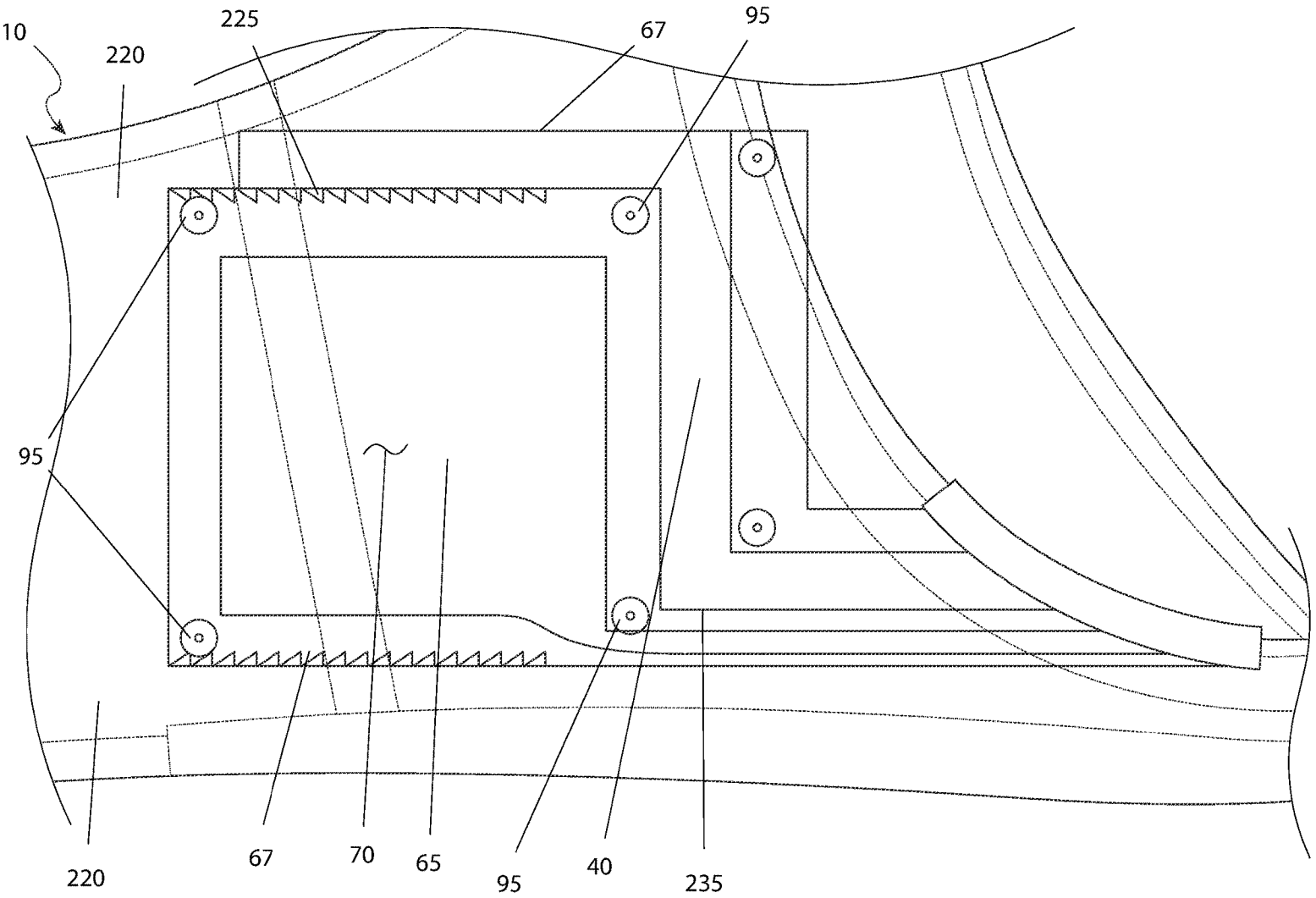
FIG. 8 is a detailed view of the gel reservoir bag 65, according to the preferred embodiment of the present device.

Referring now to FIG. 8, a detailed view of the gel reservoir bag 65, according to the preferred embodiment of the present device is depicted. The gel reservoir bag 65 is contained within one (1) wing 30 of the brassiere with modifiable cup configurations 10. It is noted that the remaining wing 30 is symmetrical in nature and is omitted for clarity. The gel reservoir bag 65, containing the gel 70 is provided as aforementioned described, and is bordered by an extra cloth layer within the fabric 220 of the brassiere with modifiable cup configurations 10. A pulley locking wheel track 225 is routed around at least four (4) roller wheels 95 and is controlled by an extra cloth layer 235. The extra cloth layer 235 is controlled by the base component 115 (as shown in FIG. 7). The extra cloth layer 235 is routed on the distal side of the bone 40 (as compared to the cup 35 (as shown in FIG. 1)). The track guards 67 are routed over the top and bottom of the wing 30 to provide protection and allow for operation of thereof. Roller wheels 95 along the track guard 67 being pulled along the movable track 68. The seamed area 130 runs over the rollable balls 96. The seam layer 110 that pulls the gel reservoir bag 65 is longer on the top due to further travel distance.

Figure 9:
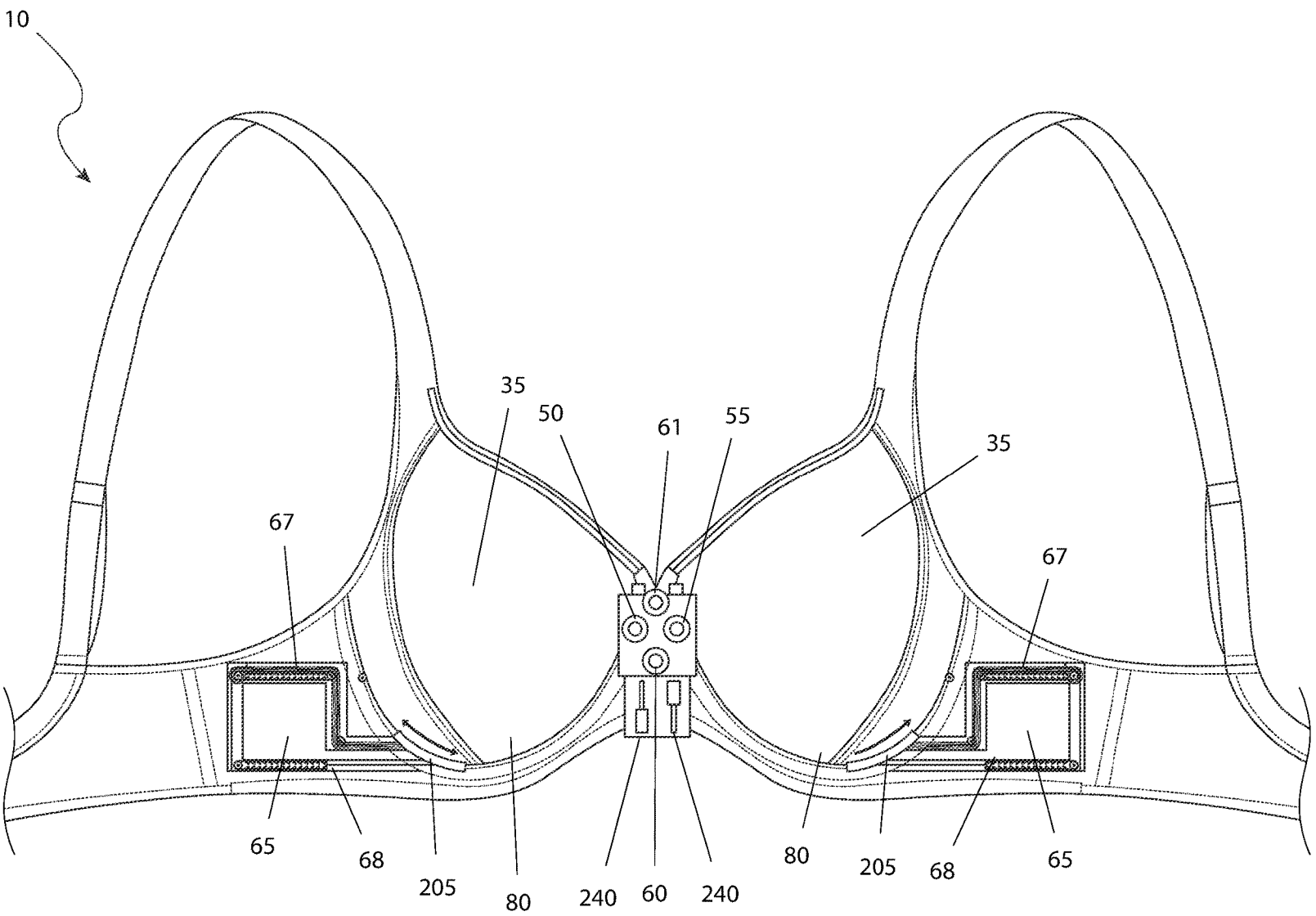
FIG. 9 is a mechanical diagram of the inner workings of the brassiere with modifiable cup configurations 10, according to the preferred embodiment of the present device.

Referring next to FIG. 9, a mechanical diagram of the inner workings of the brassiere with modifiable cup configurations 10, according to the preferred embodiment of the present device is shown. This view discloses a series of slider holes 240 and movable tracks 245, within the cup 35 that operate in conjunction with the first hole slider 50, and the second hole slider 55, second keyhole—retractable 61as aforementioned described. The track guard 67 and movable track 68 in the wing 30 and the cup 35 respectively, allow for the retractable feature to occur. This movable track 68 pulls the roller wheel 95 (not shown in this figure due to illustrative limitations) forward and reverse. To go in reverse the track guard 67 must be laid down by engaging the second keyhole-retractable 61 by turning. The second keyhole-retractable 61 is connected to the arm 71 (not shown in this figure due to illustrative limitations) which pushes the track guard 67 down. When the second keyhole-retractable 61 is turned in the opposite direction, it places the track guards 67 upward and back into its original place. When the first keyhole 60 is turned in the opposite direction, the movable track 68, pulls the roller wheel 95 (as shown in FIG. 2) that are attached to the expandable round elastic 90 (as shown in FIG. 2) and the gel reservoir bag 65 towards the original (beginning) location. When the expandable round elastic 90 in the cup 35 is pulled down by the roller wheel 95 (not shown in this FIGURE due to illustrative limitations), the gel 70 is pushed back into the gel reservoir bag 65. During such an occurrence, the roller wheel 95 on the movable track 68 (as shown in FIG. 8) pulls the expandable round elastic 90 which in the breast cup expandable bag 80 is attached to the back of the expandable round elastic 90 back into its original location. Once completed, the second keyhole-retractable 61 is turned in the opposite direction, thus placing the track guards 67 into position as aforementioned described. It is envisioned that this process may be performed only a maximum of three (3) occurrences. Each of the two (2) valve slides 205 is controlled by the first hole slider 50 and the second hole slider 55 respectively via the valve slide 205 within the movable track 68 (as shown and described in FIG. 7).

Figure 10:
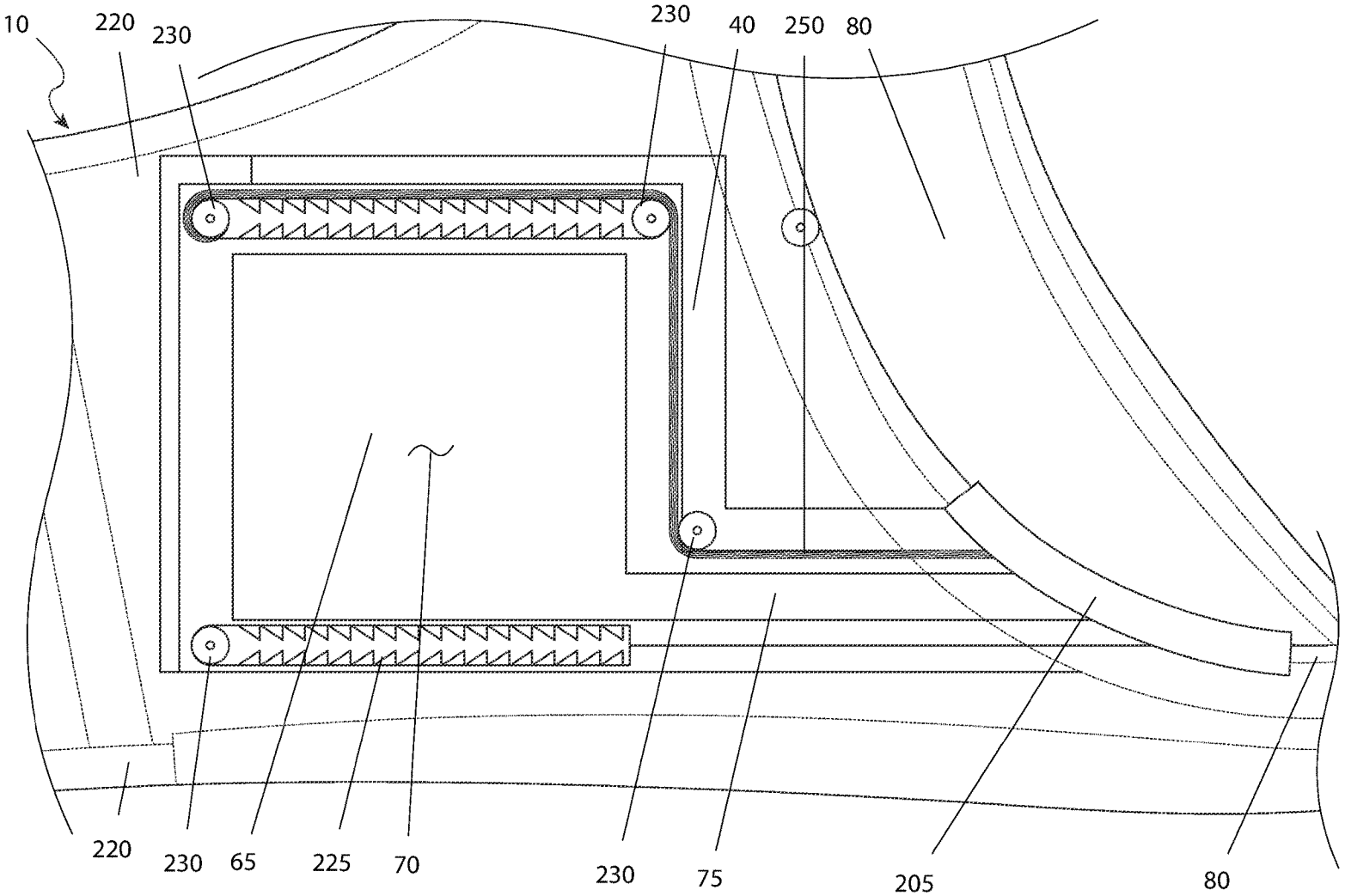
FIG. 10 is a mechanical diagram of the inner workings of the gel reservoir bag 65, according to the preferred embodiment of the present device.

Referring now to FIG. 10, a mechanical diagram of the inner workings of the gel reservoir bag 65, according to the preferred embodiment of the present device is disclosed. The gel 70 located in the gel reservoir bag 65 is routed through the tube 75 to the breast cup expandable bag 80, which is attached to the expandable round elastic 90. The gel reservoir bag 65 is bordered by the extra cloth layer 235 the pulley track 215 contained outside the fabric 220 of the brassiere with modifiable cup configurations 10. The roller wheels 95 along the track guard 67 pulled by the movable track 68 controlled by turning first keyhole 60, which move spinner wheel 170, that pull the fabric 220. A pulley locking wheel track 225 is controlled by an extra cloth layer 235 (as shown in FIG. 8). The fabric 220 is controlled by the spinner wheel 170 base component 115 (as shown in FIG. 7). The extra cloth layer 235 is routed on the distal side of the bone 40. This allows for the cloth under pulling tension 250 to be pulled into the spinner wheel 170 and stored as excess.

Figure 11:
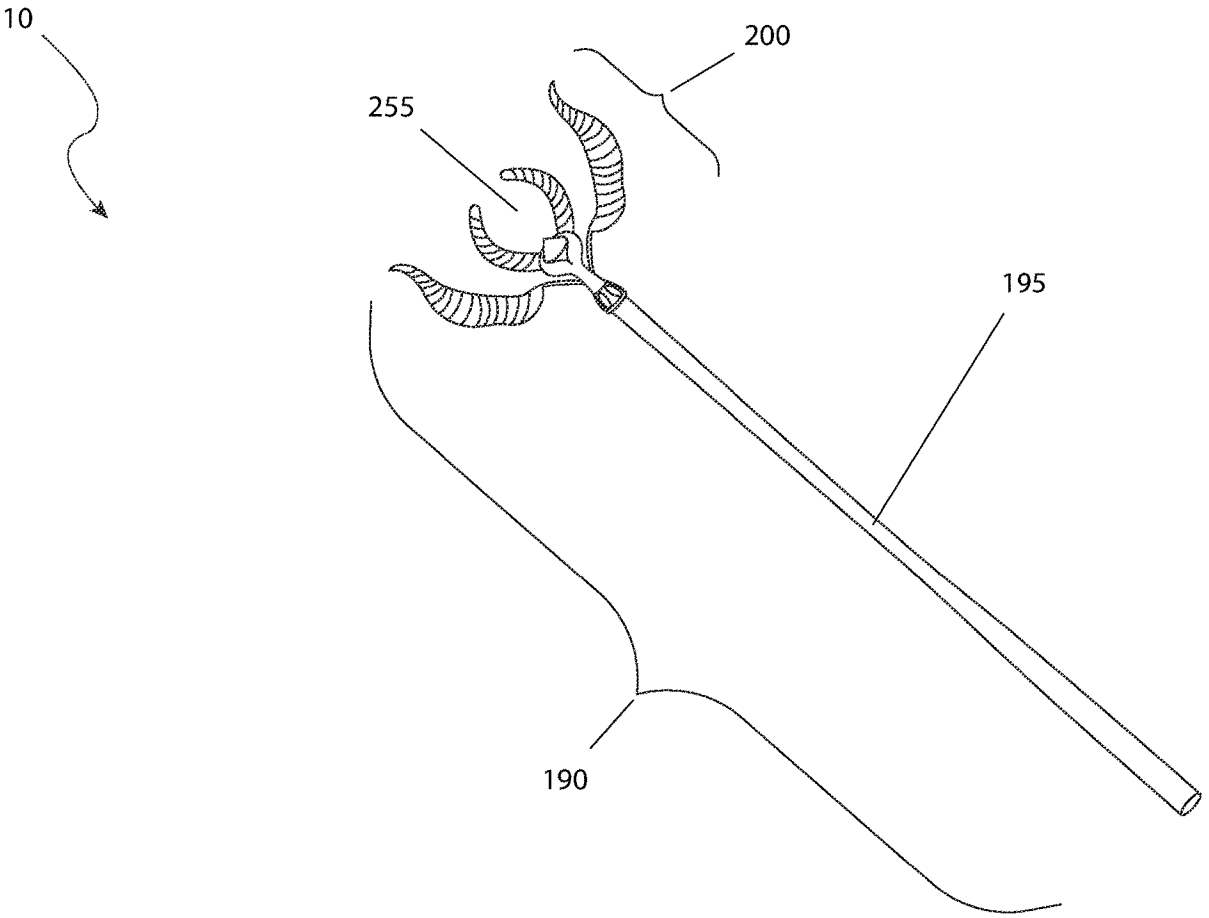
FIG. 11 is a front view of a first decorative embodiment of a key head 255 as used with the brassiere with modifiable cup configurations 10, according to the preferred embodiment of the present device; and, FIG. 12 is a front view of a second decorative embodiment of a key head 260 as used with the brassiere with modifiable cup configurations 10, according to the preferred embodiment of the present device.

Referring next to FIG. 11, a front view of a first decorative embodiment of a key head 255 as used with the brassiere with modifiable cup configurations 10, according to the preferred embodiment of the present device is depicted. The adjustment key 190 has a key shaft 195 and a key head 200 as aforementioned described. The first decorative embodiment of a key head 255 as depicted in this figure is that of a "Viking warrior sword". The adjustment key 190 may be used only in the first keyhole 60 (as shown in FIGS. 1 and/or 2).

Figure 12:
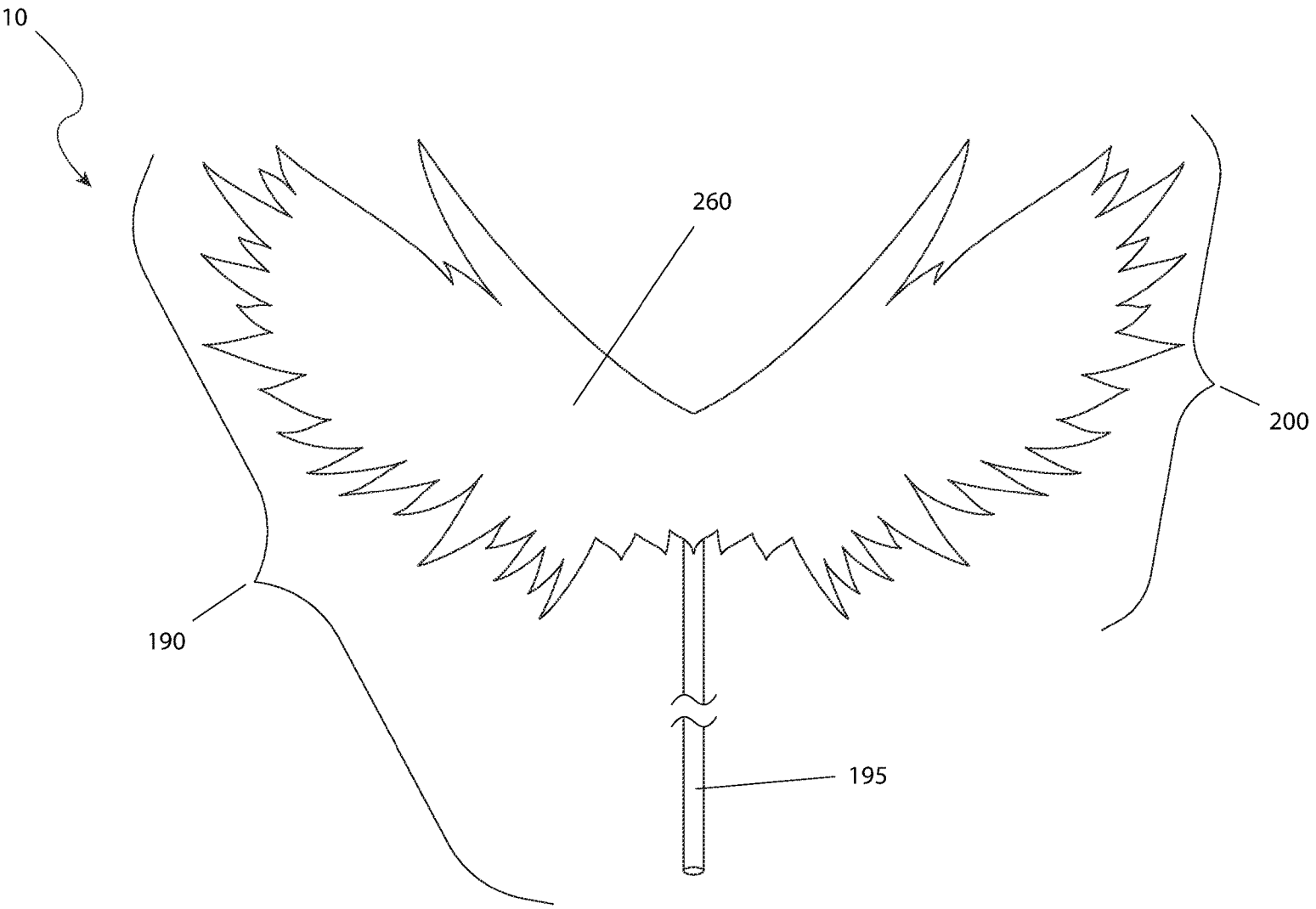

Referring to FIG. 12, a front view of a second decorative embodiment of a key head 260 as used with the brassiere with modifiable cup configurations 10, according to the preferred embodiment of the present device is shown. The adjustment key 190 consists of a key shaft 195 and key head 200 as aforementioned described. The second decorative embodiment of a key head 260 as depicted in this figure is that of an "angel wing". The adjustment key 190 may be used only in the second keyhole-retractable 61 (as shown in FIGS. 1 and/or 2), for use in retracting the brassiere with modifiable cup configurations 10.

3. Operation of the Preferred Embodiment

The preferred embodiment of the present device can be utilized by the common user in a simple and effortless manner with little or no training. It is envisioned that the brassiere with modifiable cup configurations 10 would be constructed in general accordance with FIG. 1 through FIG. 12. The user would procure the brassiere with modifiable cup configurations 10 from conventional procurement channels such as clothing stores, department stores, discount stores, specialty clothing stores, mail order and internet supply houses and the like. Special attention would be paid to the overall style, size and color of the brassiere with modifiable cup configurations 10, in much the same manner as conventional brassieres are procured. The user, envisioned to be those with unequal breast size, such as due to a mastectomy, birth defect, genetic trait, or the like, would be able to adjust the smaller size breast then match the overall size and appearance of the larger breast. The user would select the size of the brassiere with modifiable cup configurations 10 based upon the larger of the two (2) breasts.

After procurement and prior to utilization, the brassiere with modifiable cup configurations 10 would be prepared in the following manner: the user would apply the brassiere with modifiable cup configurations 10 in the same manner as a conventional brassiere; the breasts would then be lifted up into the cups 35; the user would insert the adjustment key 190 into the first keyhole 60 using the first decorative embodiment of a key head 255 of the cups 35 that needs to be made larger; the user would next either push the first hole slider 50 or second hole slider 55 to allow the smaller breast to be enlarged within the brassiere with modifiable cup configurations 10. Next, by turning the adjustment key 190 such that the seam layer 110 is pulled into the spinner wheels 170, the flow of gel 70 is induced from the gel reservoir bag 65, through the tube 75, through the tube insert 85, and into the breast cup expandable bag 80 which is attached to the expandable round elastic 90; the gel 70 is pulled from both gel reservoir bags 65 in the wings 30 such that the brassiere with modifiable cup configurations 10 stays equal on both sides. The user then decides when both cups 35 appear equal in size and at that point in time, stops turning the adjustment key 190. Then, the user may push the first hole slider 50, second hole slider 55 within the slider hole 240 back into place. This closes off the tube insert 85 and locks the gel 70 into place. The adjustment key 190 can then be removed unless retraction is needed. The gel 70 fills in the gap difference of the breast giving the illusion they are equal in size. In the aforementioned description, a first decorative embodiment of a key head 255 can be used.

Should an adjustment need to be made, the second decorative embodiment of a key head 260 is to be placed into the second keyhole-retractable 61 allowing it to be retractable. The track guard 67 and movable track 68 in the wing 30 and the cup 35 respectively, allow for the retractable feature to occur. This movable track 68 pulls the roller wheel 95 forward and reverse. To travel in reverse, the track guard 67 must be laid down, by engaging the second keyhole-retractable 61 by turning the second decorative embodiment of a key head 260. The second keyhole-retractable 61 is connected to the arm 71 which pushes the track guard 67 down. When the second decorative embodiment of a key head 260 in second keyhole-retractable 61 is turned in the opposite direction, it places the track guard 67 upward and back into its original place. When the second decorative embodiment of a key head 255 in the first keyhole 60 is turned in the opposite direction, the movable track 68 pulls the roller wheels 95 that are attached to the expandable round elastic 90 and the gel reservoir bag 65 towards the original (beginning) location. When the expandable round elastic 90 in the cup 35 is pulled down by the roller wheels 95, the gel 70 is placed back into the gel reservoir bag 65. During such an occurrence, the roller wheels 95 are pulled by the movable track 68 on the pulley track 215 and pulls the breast cup expandable bag 80 back into its original location. It is noted that the gel 70, located in the gel reservoir bag 65, is routed through the tube 75 to the breast cup expandable bag 80, which is attached to the expandable round elastic 90.

The gel reservoir bag 65 is bordered by the extra cloth layer 235 contained within the fabric 220 of the brassiere with modifiable cup configurations 10. The rollable wheels 95 are pulled over the track guard 67 which lays on the movable track 68 and is controlled by spinner wheel 170 in the base component 115. The extra cloth layer 235 is routed on the distal side of the bone 40. This allows for the cloth under pulling tension 250 to be pulled into the spinner wheels 170 that lock into place and stored as excess. Once completed, the key head 200 in the second keyhole-retractable 61 is turned, thus placing the track guard 67 into position as aforementioned described. The aforementioned process can then be repeated. When the desired size is reached, then the respective first hole slider 50 or second hole slider 55 can be pushed back into place, the second decorative embodiment of a key head 260 can be removed, and then the first decorative embodiment of a key head 255 can be removed. It is envisioned that this process may be performed only a maximum of three (3) occurrences.

During use of the brassiere with modifiable cup configurations 10, normal usage patterns, identical to that of a conventional brassiere would be followed. It is envisioned that the brassiere with modifiable cup configurations 10 could be used with all types of outer clothing. When finished with use, the brassiere with modifiable cup configurations 10 would be removed. Should cleaning be required, the brassiere with modifiable cup configurations 10 must be washed only by hand and air dried.

The foregoing descriptions of specific embodiments of the present device have been presented for purposes of illustration and description. They are not intended to be exhaustive or to limit the device to the precise forms disclosed, and obviously many modifications and variations are possible in light of the above teaching. The embodiments were chosen and described in order to best explain the principles of the device and its practical application, to thereby enable others skilled in the art to best utilize the device and various embodiments with various modifications as are suited to the particular use contemplated.

What is claimed is:

1. A brassiere with selective cup modification comprising:

a pair of straps comprising a first strap and a second strap each having a respective first adjustable clip and second adjustable clip;

a pair of hooks comprising a first plurality of hooks and a second plurality of hooks each secured to a respective distal end of a pair of wings comprising a first wing and a second wing;

a pair of cups comprising a first cup secured to a proximal end of the first wing and a second cup secured to a proximal end of a second wing;

a bone structure comprising a plurality of bones disposed within a periphery of the pair of cups and disposed within the pair of wings thereby providing the brassiere with a semi-rigid framework;

a center gore disposed between the pair of cups configured to separate each cup;

a first hole slider disposed within the gore and adjacent a proximal edge of the first cup;

a second hole slider disposed within the gore and adjacent a proximal edge of the second cup, the second hole slider being positioned in mirror opposite to the first hole slider;

a first keyhole disposed within the gore and centrally subjacent the first hole slider and the second hole slider; and, a second keyhole disposed within the gore and centrally superjacent the first hole slider and the second hole slider; and, wherein each of the first adjustable clip and the second adjustable clip permits a user to adjust a length of the first strap and the second strap;

wherein the plurality of hooks permit the user to secure the brassiere about a torso of the user when the first plurality of hooks and the second plurality of hooks are removably engaged;

wherein the first cup and the second cup are each configured to support and retain a respective breast of the user;

wherein a distal end of the first strap and the second strap is secured to a respective upper side of the first wing and the second wing and adjacent the respective first plurality of hooks and the second plurality of hooks;

wherein a proximal end of each respective strap is secured to an upper side of each respective cup; and, wherein the brassiere is adapted to provide an outward appearance of symmetrical breasts for a user with a pair of different-sized breasts.

2. The brassiere of claim 1, further comprising a gel reservoir bag located within each first wing and second wing, the gel reservoir bag being filled with a gel that retains its structural form during movement.

3. The brassiere of claim 2, wherein the gel from the gel reservoir bag is capable of being transported via a tube to a breast cup expandable bag through a tube insert, and wherein the breast cup expandable bag is constricted by an expandable round elastic featuring a roller wheel on each end that traverse a movable structure.

4. The brassiere of claim 3, wherein the movement of the breast cup expandable bag is regulated by a motion of a seam layer into and out of a base component, which interfaces with the first hole slider, the second hole slider, and the first keyhole.

5. The brassiere of claim 4, wherein said base component comprises:

a set of four axle pins attached to a base plate;

a pair of two upper mechanical wheels corresponding to the first hole slider and the second hole slider;

a first key wheel in mechanical communication with the pair of two upper mechanical wheels; and, a spinner wheels mounted atop each one mechanical wheel adapted to coil and store the seam layer.

6. The brassiere of claim 5, wherein the base component further comprises a cloth layer interfacing with the spinner wheel, and arms inked to a second key wheel which engage a track guard in each cup.

7. The brassiere of claim 2, wherein the gel reservoir bag includes a cloth layer positioned on its top and bottom, with rollable wheels sewn inside, and wherein the rollable wheels propel the gel reservoir bag along a one-way track guard situated above a movable track.

8. The brassiere of claim 7, wherein rollable balls are situated on a respective distal side of the plurality of bone allowing for the movement of the cloth layer along the side of the plurality of bone, and a tube directs the gel below the plurality of bone with the plurality of bone functioning as a scraper, facilitating the movement of the gel to the location of the tube.

9. The brassiere of claim 1, further comprising an adjustment key configured for insertion into the first keyhole to engage with mechanical wheels or each respective key wheel, wherein the adjustment key includes a key shaft and a key head which can be ornately decorated.

10. The brassiere of claim 9, wherein the arms act as a retractable component of the second keyhole wheel and are connected to the track guards inside each cup, enabling a repositioning of the track guards upon rotation of the second keyhole.

11. The brassiere of claim 10, further comprising:

a valve slide associated with the tube for controlling a flow of gel between the gel reservoir bag and the expandable bag;

a movable track incorporated in the wing and cup for aiding in a movement of the gel and associated components;

roller wheels positioned along the movable track for facilitating the movement of associated components; and, a pulley locking wheel track routed around roller wheels and controlled by an extra cloth layer.

12. The brassiere of claim 11, wherein the tube is positioned at a bottom of the bone structure associated with the wing, facilitating a scraping or pushing of gel into the tube.

13. The brassiere of claim 12, wherein the valve slide is controlled by a wire positioned within the movable track, and the wire's position is determined by at least one of a first hole slider and a second hole slider.

14. The brassiere of claim 13, wherein the extra cloth layer is further routed on a distal side of a bone structure as compared to an associated cup.

15. The brassiere of claim 14, wherein the movable track comprises a track guard positioned over a top and bottom of the wing, providing protection and aiding in an operation of associated components.

16. The brassiere of claim 15, further comprising a retractable feature within the cup, said retractable feature operating in conjunction with a series of slider holes and the movable track.

17. The brassiere of claim 16, wherein the retractable feature is controlled by turning a second keyhole, which in turn is connected to an arm that modulates the position of the track guard.

18. The brassiere of claim 17, wherein the gel reservoir bag is bordered by the extra cloth layer and is positioned within a fabric of the brassiere, further comprising a pulley track external to the fabric, the pulley track being controlled by the extra cloth layer.

19. The brassiere of claim 18, wherein the adjustment key with a key head in a form of a Viking warrior sword interfaces specifically with the first keyhole.

20. The brassiere of claim 19, wherein the adjustment key with a key head in a form of an angel wing interfaces specifically with the second keyhole and is used for retracting the brassiere.

* * * * *